US006006734A

United States Patent [19]

Sodaro

[11] Patent Number: 6,006,734

[45] Date of Patent: Dec. 28, 1999

[54] BOW QUIVER FOR ARCHERY

[75] Inventor: John C. Sodaro, P. O. Box 71, Monkton, Vt. 05469

[73] Assignees: Arvid A. Ames, Tomahawk, Wis.; John C. Sodaro, Monkton, Vt.

[21] Appl. No.: 09/122,214

[22] Filed: Jul. 25, 1998

Related U.S. Application Data

[60] Provisional application No. 60/054,173, Jul. 30, 1997.

[51] Int. Cl.[6] ..... F41B 5/06

[52] U.S. Cl. ..... 124/86; 124/25.5; 224/916

[58] Field of Search ..... 124/23.1, 25.5, 124/25.7, 86, 88; 224/916

[56] References Cited

U.S. PATENT DOCUMENTS

| | | | |
|---|---|---|---|
| 4,101,704 | 7/1978 | Hiles | 428/218 |
| 4,156,496 | 5/1979 | Stinson | 124/25.7 |
| 4,346,205 | 8/1982 | Hiles | 528/53 |
| 4,363,312 | 12/1982 | Spitzke | 124/25.7 X |
| 4,621,606 | 11/1986 | Toth | 124/86 X |
| 4,635,611 | 1/1987 | Priebe | 124/25.7 |
| 4,704,800 | 11/1987 | Stinson | 124/25.7 X |
| 4,777,739 | 10/1988 | Hiles | 36/43 |
| 4,788,961 | 12/1988 | Toth | 124/88 X |
| 5,265,584 | 11/1993 | Judson et al. | 124/86 |
| 5,265,585 | 11/1993 | Stinson | 124/88 |
| 5,452,703 | 9/1995 | Bateman | 124/25.7 X |
| 5,566,665 | 10/1996 | Stinson | 124/86 |

FOREIGN PATENT DOCUMENTS

| | | | |
|---|---|---|---|
| 752176 | 2/1967 | Canada | 124/25.5 |

*Primary Examiner*—John A. Ricci
*Attorney, Agent, or Firm*—Theodore R. Touw

[57] ABSTRACT

A bow-mounted archery quiver having a twin-hood design provides improved noise reduction and balance features. Arrows are held in a vertical position and may be removed in either of two directions relative to the archer. An arrow-holding element is formed from an elastomeric material, preferably a viscoelastic polyurethane elastomer. The quiver is provided with an offset configuration so as not to interfere with operation of the bow. The quiver may be mounted to the side of the handle riser of a bow using a dovetail mounting arrangement. A quick release mechanism allows for positive one-hand push-button release of the quiver from the archery bow.

8 Claims, 4 Drawing Sheets

BOW QUIVER FOR ARCHERY

This application is related to U.S. Provisional Application Ser. No. 60/054,173 "Bow Quiver For Archery" submitted to the United States Patent and Trademark Office on Jul. 30, 1997.

TECHNICAL FIELD

The present invention relates to the field of archery; more specifically, it relates to an apparatus for holding arrows that is attachable to an archery bow and which is especially suited for hunting.

BACKGROUND ART

It is often advantageous in archery to use a quiver to hold spare arrows. For quivers that are to be used in hunting applications it is desirable that the quiver be bow-mounted to allow rapid fire and reload capability. Other desirable features of quivers used for hunting are that they have low weight, that they be balanced, and that they be quiet. A still further desirable feature is that the quiver, whether used in target archery or hunting, be quickly de-mountable, especially in the case of hunting quivers.

U.S. Pat. No. 5,566,665 to Stinson teaches provision of a mount for mounting a quiver to a bow for optimal mass positioning and distribution, to dynamically balance the bow and quiver combination. The mount includes an elongated extension plate which is attached to the side of the bow handle riser and includes an offset longitudinal configuration, with a releasable attachment device for the quiver disposed outwardly from the bow. The offset configuration positions the quiver close to the plane in which the bowstring moves when shooting an arrow, so that the bow and quiver assembly have an optimum mass distribution that is dynamically balanced and thus minimizes vibration and torque forces acting on the bow when an arrow is shot, thus improving accuracy and shooting comfort.

U.S. Pat. No. 5,265,584 to Judson et al. describes a quiver for holding a plurality of arrows, the quiver including a base member and spaced arrow-holding assemblies. Each arrow-holding assembly includes a plurality of independently pivotable arrow-engaging tabs. An arrow is removed from the quiver by moving the arrow to pivot the tabs. The arrow-holding assemblies may be adjusted along the longitudinal dimension of the base member. The adjustment may be made by use of a mounting flange affixed to each arrow-holding assembly. The mounting flange has a groove corresponding to a tongue in a base member. Each arrow holding assembly may include a base plate having a stop plate upwardly extending therefrom, such that the stop plate limits the pivotable movement of the pivotable tabs. The quiver may also be provided with a mounting bracket for mounting the quiver to a bow. Arcuate slots in one end of the bracket allow pins to move within the arcuate slots to adjust the position of the quiver relative to the bow.

U.S. Pat. No. 4,156,496 to Stinson teaches a bow-mounted arrow quiver that includes an elongated frame, a shaft holder and support, and an arrowhead-receiving housing and shield. A compartmentalized member of resilient material having a plurality of openings or recesses therein is disposed within the housing for engaging and retaining the arrowheads in a snug and secure manner to prevent the arrows from slipping out of place or falling from the quiver and also to prevent damage to the arrowheads while at the same time preventing any rattling or other such sounds. A mounting plate adapted for permanent securement to a bow handle or other surface cooperates with a mounting pad and latch means on the frame to releasably but positively mount the quiver to the bow. A forward stabilizing clip assembly may be included to further stabilize the mounting of the quiver. A special compartment is preferably included in the arrowhead-receiving member and contains a scent-retaining element for any of a variety of hunter's scented liquids. The shaft holder mounts to the frame between clamping elements having mating lugs which prevent over-compression of the holder which might otherwise distort the shaft-receiving portions and result in undesired loosening of the shafts.

DISCLOSURE OF INVENTION

Disclosed herein is a lightweight quiver for holding arrows, designed to attach directly to the archery bow. The quiver is designed to hold arrows in a normally vertical position, i.e., parallel to the archery bow, attached to the side of the bow handle riser. The quiver is quickly and quietly detachable from the bow. It allows arrows to be removed either away from the archer or toward the archer and has a novel hood design that reduces noise emanating from the quiver.

A frame connects three major elements of the quiver, viz., the arrow hood, the arrow shaft holder and the mounting mechanism. The arrow hood and arrow shaft holders are positioned at one end of the frame. A two-piece sliding mount connects the middle of the frame to the bow at one side of the bow. The frame is bent in its middle portion so the arrow hood and arrow shaft holder as well as the arrows are held far enough from the bow to avoid interference with operation of the bow. A push button release mechanism contained within the portion of the mount that is attached to the frame allows the quiver to be removed quickly from the bow by sliding the quiver toward or away from the bow string while the push button is depressed.

The arrow shaft holder is formed of an elastomer such as rubber, with slots and retaining fingers to grip and hold the arrow shafts. The arrow shaft holder may be formed from conventional elastomers or from a vibration-damping viscoelastic elastomer.

The arrow hood protects arrow tips and prevents snagging when the quiver is used in the field. It has a novel twin-hood-chamber design. Quiver noise is reduced by reducing the volume of the hood and balance is improved by the improved weight distribution that the twin hoods provide, the twin hoods being disposed symmetrically alongside the bow and moving the hoods' weight and arrows' weight further from the quiver's center.

Therefore it is an object of the present invention to provide a bow-mounted quiver allowing the archer to remove arrows either toward himself/herself or away from himself/herself.

It is an another object of the present invention to provide a bow-mounted quiver that is easily detachable from the archery bow.

It is a further object of the present invention to provide a bow-mounted quiver with reduced quiver noise and improved balance in comparison with quivers available heretofore.

BRIEF DESCRIPTION OF DRAWINGS

The novel features believed characteristic of the invention are set forth in the appended claims. The invention itself however, as well as a preferred mode of use, and further objects and advantages thereof, will best be understood by reference to the following detailed description of an illustrative embodiment when read in conjunction with the accompanying drawings, wherein:

BEST MODE FOR CARRYING OUT THE INVENTION

Figure 1:
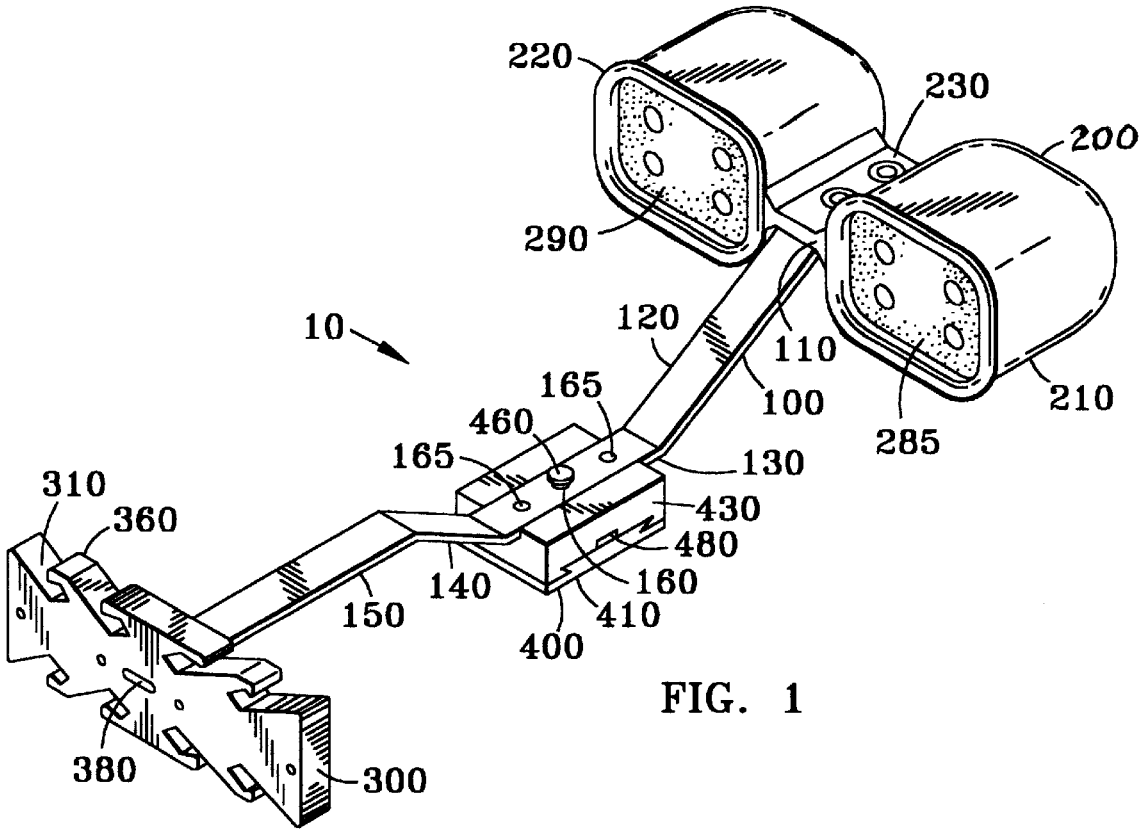
FIG. 1 is a perspective view of an archery bow quiver made in accordance with the invention.
Figure 3:
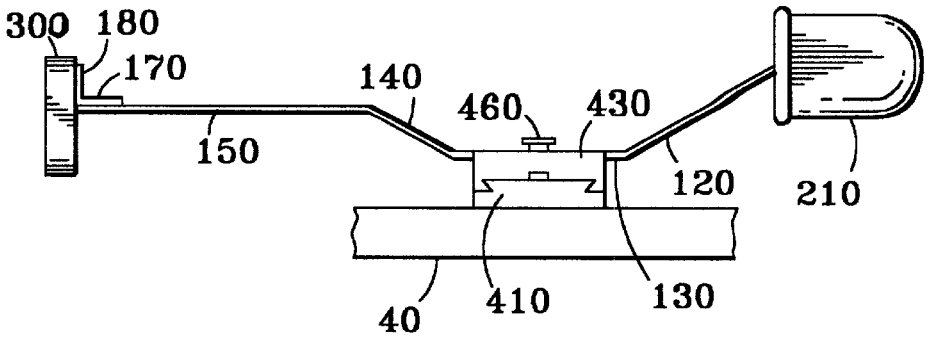
FIG. 3 is a side view of an embodiment of an archery bow quiver.

FIG. 1 is a perspective drawing of the quiver assembly 10 of the invention. Connecting element 100 supports arrow hood 200 for protecting arrow heads at an upper end 110, arrow shaft holder 300 for holding arrow shafts at the opposite lower end 150, and archery bow mounting assembly 400 in a middle portion 130. Connecting element 100 additionally has upper intermediate portion 120 connecting middle portion 130 to upper end 110. Intermediate portion 120 is bent up and angled away from middle portion 130, while upper end 110 is bent back toward the plane of middle portion 130. Connecting element 100 additionally has lower intermediate portion 140 connecting middle portion 130 to lower end 150. Intermediate portion 140 is bent up and angled away from middle portion 130, while lower end 150 is bent back toward the plane of middle portion 130. Thus middle upper end 110, middle portion 130 and lower end 150 are approximately parallel to one another. This allows alignment of hood assembly 200 to arrow shaft holder 300 as well as keeping arrow hood 200 and arrow shaft holder 300 away from archery bow 40 as shown in FIG. 3, described below. Middle portion 130 has center hole 160 and mounting holes 165 for mounting connecting element 100 to archery bow mounting element 400. Connecting element 100 may be made from plastic, aluminum, steel, or composite or laminate materials with non-metallic materials preferred to reduce quiver noise and to reduce the need for protective liners.

Figure 2:
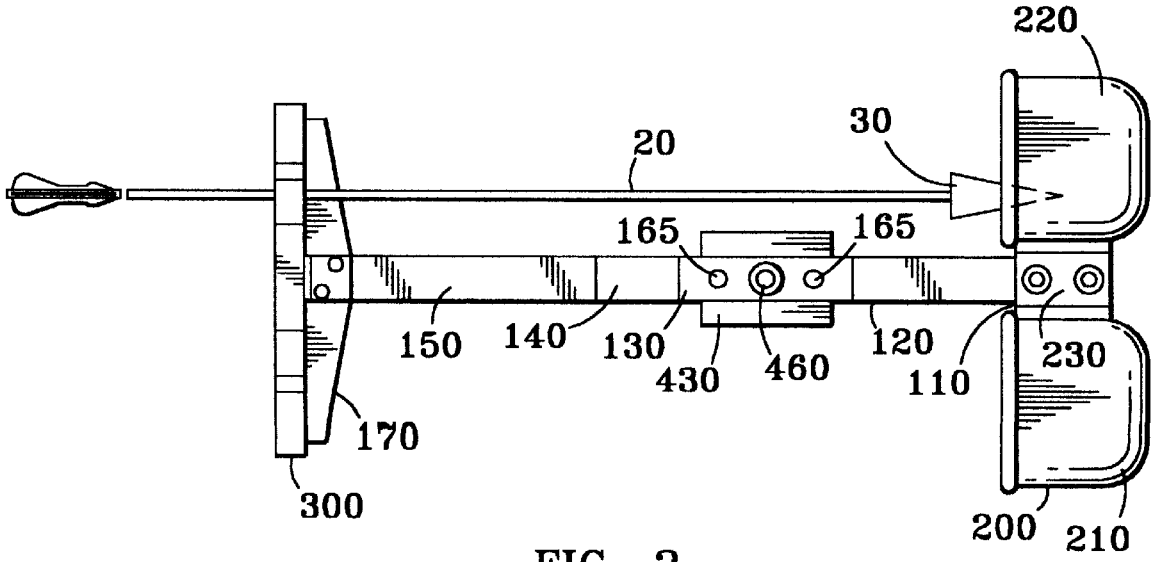
FIG. 2 is a front view of an embodiment of an archery bow quiver.

Turning to FIGS. 2 and 3, attached at a right angle to lower end 150 of connecting element 100 is arrow shaft holder mounting bracket 170. Arrow shaft 20 is shown inserted into arrow shaft holder 300 and arrow head 30 under arrow hood 200. In FIG. 3 mounting bracket 400 is shown attached to archery bow 40.

Figure 4:
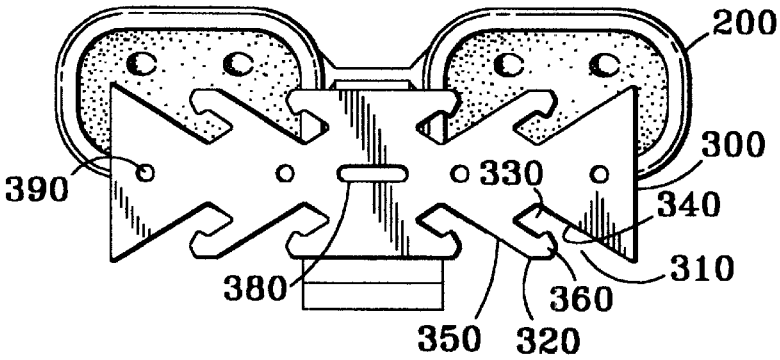
FIG. 4 is a bottom view of an embodiment of an archery bow quiver.

Turning to FIG. 4, arrow shaft holder 300 is a one-piece unit molded or machined from elastomer. Several arrow shaft holding regions 310 are formed along the outside edge 320 of shaft holder 300. Each arrow shaft holding region 310 comprises a through-hole 330 communicating to outside edge 320 by slot 340. Arrow shaft 20 is retained in through-hole 330 by flexible finger 350 having extension 360 extending toward and narrowing slot 310. Flexible finger 350 exerts pressure on the arrow shaft to push it against through-hole 330 keeping arrow shaft 20 in place by friction. Arrow shaft holder 300 may be formed from conventional elastomers such as rubber or from a vibration-damping viscoelastic elastomer such as "Sorbothane®," available from Sorbothane Inc. of Kent, Ohio (www.sorbothane.com). The use of "Sorbothane®" viscoelastic elastomer reduces vibration transmitted to the bow by the arrows. "Sorbothane®" is described in U.S. Pat. Nos. 4,101,704, 4,346,205, and 4,777,739 to Hiles, the entire disclosure of each of which is hereby incorporated by reference. The viscoelastic polymer "Sorbothane®" is a particularly good material from which to fabricate arrow shaft holder 300, not only because of its vibration damping, but also because of its temperature stability properties. "Sorbothane®" is a thermoset, polyether based, polyurethane material available in a range of durometer hardness values. It is a flexible polyurethane of essentially linear structure containing unsatisfied hydroxyl groups, and can be made with a compression set of less than 15%, an elongation at break of at least 500%, and a recovery after compression which is delayed by at least 0.7 seconds, which are preferred characteristics for arrow shaft holder 300. I have found that a bow-mounted quiver having an arrow shaft holder made with a viscoelastic polymer such as "Sorbothane®" has exceptional performance in terms of vibration damping and quietness in comparison with quivers available heretofore.

Figure 5:
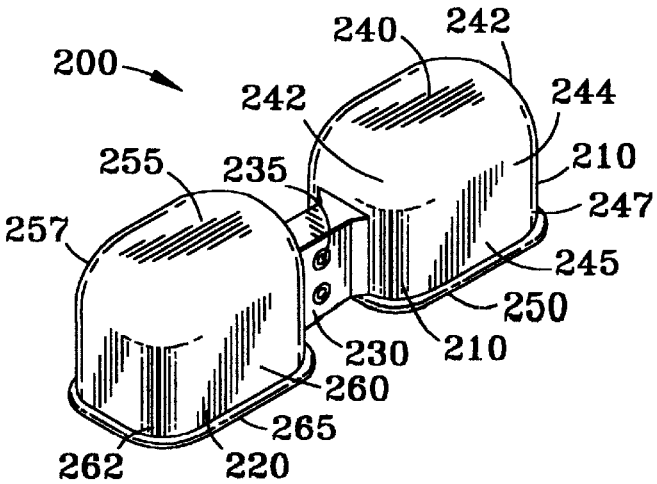
FIG. 5 is a perspective view of a hood portion of an embodiment of an archery bow quiver.

FIG. 5 is a perspective view of arrow hood 200. Arrow hood 200 is comprised of two hollow hood sections 210 and 220 joined by hood section connecting element 230. Hood section connecting element 230 has mounting holes 235 for mounting arrow hood 200 to upper end 110 of connecting element 100. Both hollow hood sections 210 and 220 are identical. Hollow hood section 210 comprises upper vault-shaped section 240 having rounded corners 242 joined to the top edge of rectangular wall section 245 having rounded corners 247. A lower lip 250 keeps the bottom edge of wall section 245 rigid. Hollow hood section 220 comprises upper vault-shaped section 255 having rounded corners 257 joined to the top edge of rectangular wall section 260 halting rounded corners 262. A lower lip 265 keeps the bottom edge of wall section 260 rigid.

Figure 6:
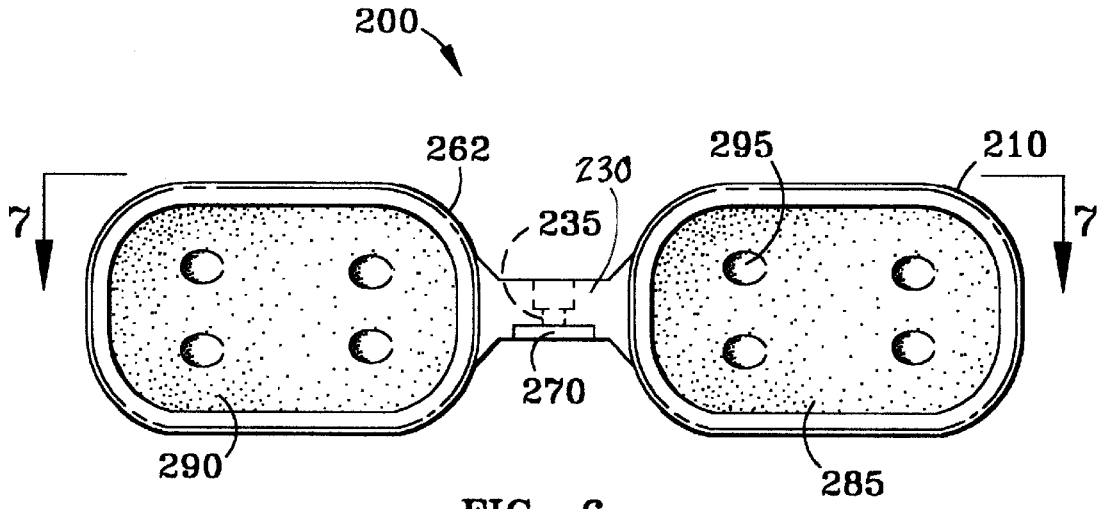
FIG. 6 is a top view of a hood portion of an embodiment of an archery bow quiver.
Figure 7:
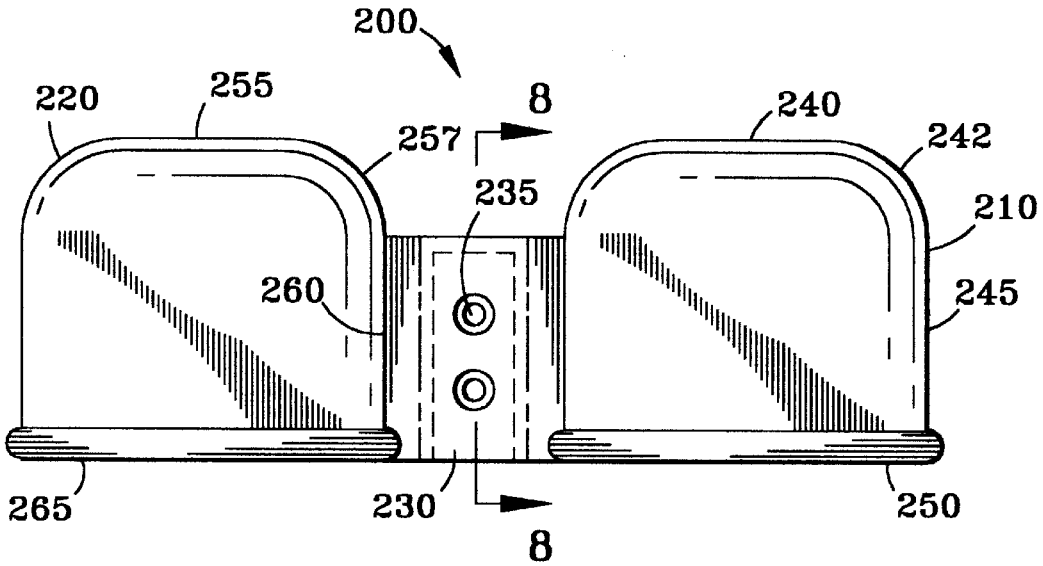
FIG. 7 is a front elevation view of the archery bow quiver hood portion of FIG. 6, taken at 7—7.
Figure 8:
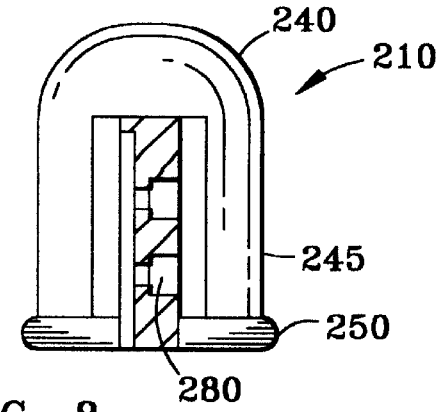
FIG. 8 is a side-sectional view of the archery bow quiver hood portion of FIG. 7, taken through section 8—8.

FIG. 6 is a top view of arrow hood 200. A recess 270 in hood section connecting element 230 receives upper end 110 of connecting element 100. FIG. 7 is a front elevation view taken at 7—7 of FIG. 6. FIG. 8 is a section through 8—8 of FIG. 7, showing hood mounting bolts 280, which are recessed into hood section connecting element 230. Arrow hood 200 can be made from molded, cast or machined plastic, pressed or cast metal, or composite and laminate materials. The edges of the hood are rounded to minimize snagging when quiver assembly 10 is used for hunting. Hood sections 210 and 220 are substantially filled with replaceable foam rubber inserts 285 and 290 for holding arrow heads 30 pressed into the foam rubber. Each foam insert has conical recesses 295 for arrow heads. Recesses 295 (about 18 mm in diameter, tapering to a point about 12 mm deep) are aligned with through-holes 330 in arrow shaft holder 300. Foam rubber inserts 285 and 290 may be formed of four-pound closed-cell polymer foam, for example.

Figure 9:
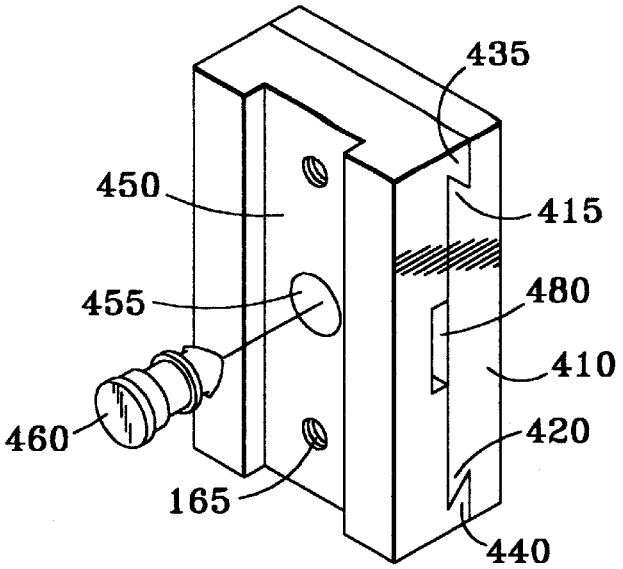
FIG. 9 is a perspective view of a detail showing a quick release portion of an embodiment of the invention.
Figure 10:
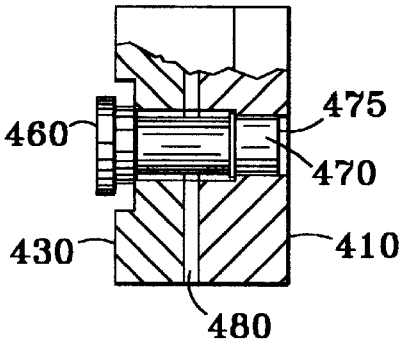
FIG. 10 is top view of the quick release portion of FIG. 9.
Figure 11:
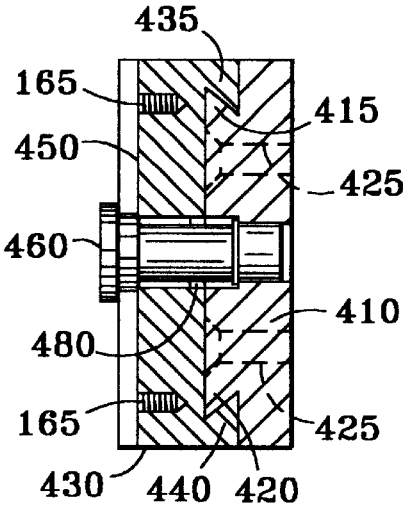
FIG. 11 is a side view of the quick release portion of FIG. 9.
Figure 12:
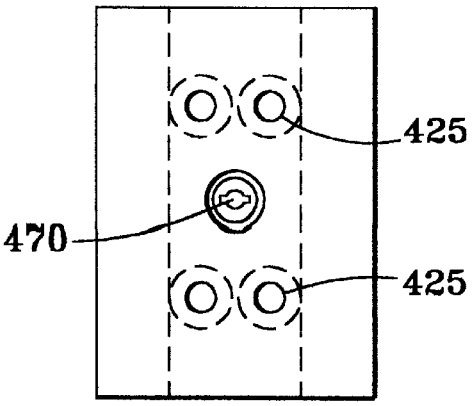
FIG. 12 is a front view of the quick release portion of FIG. 9.

FIG. 9 is a perspective view of mounting assembly 400. Base element 410 of mounting assembly 400 is attached to archery bow 40. Detachable element 430 has slot 450 for receiving middle portion 130 of connecting element 100 which is attached by screws to threaded holes 165. Base element 410 has upper and lower dovetail joints 415 and 420 which slidably mate with upper and lower dovetail joints 435 and 440 on detachable element 430. The dovetail joints are oriented to allow the quiver (except for the fixed base element 410 of the mounting assembly) to slide directly toward or away from the string of the bow. FIG. 10 shows quick release button 460 contained in detachable element 430 communicating by through-hole 465 to quick release mechanism 470 located in cavity 475 of base element 410. Pushing quick release button 460 allows sliding motion between base element 410 and detachable element 430. FIGS. 11 and 12 show additional views of the quick release portion of FIG. 9. Mounting through-holes 425 are shown in base element 410 for screws for attaching base element 410 to archery bow 40. Base element 410 and detachable element 430 can be machined from plastic, aluminum, or composite or laminated materials.

In use, the quiver is mounted to the side of the bow handle riser, with base element 410 attached to the bow, with hood sections 210 and 220 oriented toward the top of the bow, and with arrow shaft holder 300 oriented toward the bottom of the bow.

INDUSTRIAL APPLICABILITY

The applications of the invention include both target archery and bow and arrow hunting. The invention provides for a bow-mounted quiver to safely hold spare arrows in a manner allowing quick access. The quiver is lightweight, balanced, quiet, and easily detachable, allowing use of the bow without the quiver. Thus safety and enjoyment of the sport are improved.

The description of the embodiments of the present invention is given above for the understanding of the present invention. It will be understood that the invention is not limited to the particular embodiments described herein, but is capable of various modifications, rearrangements, and substitutions that will now become apparent to those skilled in the art, without departing from the scope of the invention. Functionally equivalent elements and materials may be substituted for those used in the embodiment shown. For example, the arrow shaft holder 300 may be made with through-holes 330 and slots 340 on only one side for holding a total of four arrows, instead of the symmetric eight-arrow design shown in FIGS. 1 and 4. Variations in mounting arrangements may be made to accommodate a compound bow, recurve bow, or other types of bow. For another example, a suitable form of a viscoelastic polymer material such as "Sorbogel" (available from Sorbothane Inc. of Kent, Ohio) may be substituted for the closed-cell foam rubber inserts 285 and 290 in the twin hoods 210 and 220. Therefore it is intended that the following claims cover all such modifications and changes as fall within the true spirit and scope of the invention.

I claim:

1. An archery quiver for holding arrows, mountable to an archery bow, comprising:

(a) connecting member having a top end, a middle, and a lower end;

(b) quiver mounting means disposed on said middle of said connecting member for holding said connecting member parallel to a side of said archery bow, said mounting means being slidably removable in a direction perpendicular to said side of said archer bow, and said mounting means further comprising a bow mounting plate having a pair of dovetail projections along parallel edges of a top face of said bow mounting plate, a quiver mounting plate having a dovetail slot in a bottom face of said quiver mounting plate for engaging said pair of dovetail projections on said top face of said bow mounting plate; and release means operable by a captured push-button in said quiver mounting plate;

(c) a pair of arrow protection hoods for protecting arrow tips, mounted on said upper end of said connecting member, said arrow protection hoods being disposed one on either side of said upper end of said connecting member in a direction perpendicular to said side of said archery bow; and (d) an arrow shaft engaging member for firmly but releasably holding arrow shafts, disposed on said lower end of said connecting member and aligned to said pair of arrow protection hoods, said arrow shaft engaging member further comprising an elongate bar having an outside edge, a plurality of bores for receiving said arrow shafts, each of said bores communicating to said outside edge of said elongate bar by a slot, and a plurality of flexible fingers each having a tip end bent toward and narrowing said slot for applying compressive force to said arrow shafts.

2. An archery quiver for holding arrows, mountable to an archery bow, comprising:

(a) a connecting member having a top end, a middle, a lower end, a top transitional portion between said middle and said top end and a bottom transitional portion between said middle and said bottom end, said top transitional portion being bent away from said middle portion and bent toward said top end, and said bottom transitional portion being bent away from said middle portion and bent toward said bottom end;

(b) quiver mounting means disposed on said middle of said connecting member for holding said connecting member parallel to a side of said archer bow, said mounting means being slidably removable, said quiver mounting means further comprising a bow mounting plate having a pair of dovetail projections along parallel edges of a top face of said bow mounting plate, a quiver mounting plate having a dovetail slot in a bottom face of said quiver mounting plate for engaging said pair of dovetail projections on said top face of said bow mounting plate, and release means operable by a captured push button in said quiver mounting plate;

(c) a pair of arrow protection hoods for protecting arrow tips, mounted on said upper end of said connecting member, said arrow protection hoods disposed one on either side of said upper end of said connecting member; and (d) an arrow shaft engaging member for firmly holding arrow shafts, disposed on said lower end of said connecting member and aligned to said pair of arrow protection hoods.

3. An archery quiver as in claim 2 wherein said elongate bar is formed from an elastomeric material.

4. An archery quiver as in claim 2 wherein said elongate bar comprises a viscoelastic elastomer.

5. An archery quiver as in claim 2 wherein said viscoelastic elastomer has a compression set of less than 15%, an elongation at break of at least 500%, and a recovery after compression which is delayed by at least 0.7 seconds.

6. An archery quiver as in claim 2 wherein said viscoelastic elastomer comprises a flexible polyurethane of essentially linear structure containing unsatisfied hydroxyl groups.

7. An archery quiver for holding arrows, mountable to an archery bow comprising:

(a) a connecting member having a top end, a middle, and a lower end;

(b) quiver mounting means disposed on said middle of said connecting member for holding said connecting member parallel to a side of said archery bow, said quiver mounting means being slidably removable in a direction perpendicular to said side of said archery bow, said quiver mounting means comprising (i) a bow mounting plate having a pair of dovetail projections along parallel edges of a top face of said bow mounting plate, (ii) a quiver mounting plate having a dovetail slot in its bottom face for engaging said pair of dovetail projections on said top face of said bow mounting plate, and (iii) release means operable by a captured push button in said quiver mounting plate;

(c) a pair of arrow protection hoods for protecting arrow tips, mounted on said upper end of said connecting member, said arrow protection hoods being disposed one on either side of said upper end of said connecting member in a direction perpendicular to said side of said archery bow; and (d) an arrow shaft engaging member for firmly but releasably holding arrow shafts, disposed on said lower end of said connecting member and aligned to said pair of arrow protection hoods, said arrow shaft engaging member comprising (i) an elongate bar having an outside edge, (ii) a plurality of bores for receiving said arrow shafts, each of said bores communicating to said outside edge of said elongate bar by a slot, and (iii) a plurality of flexible fingers each having a tip end bent toward and narrowing said slot for applying compressive force to hold said arrow shafts.

8. An archery quiver for holding arrows, mountable to an archery bow as in claim 7 wherein each of said arrow protection hoods further comprises a foam insert disposed within each of said arrow protection hoods for holding arrowhead points.

* * * * *